US007383017B2

(12) United States Patent
Ushio

(10) Patent No.: US 7,383,017 B2
(45) Date of Patent: Jun. 3, 2008

(54) CURL CORRECTING DEVICE AND IMAGE FORMING APPARATUS

(75) Inventor: Kenji Ushio, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 10/943,691

(22) Filed: Sep. 17, 2004

(65) Prior Publication Data

US 2005/0063747 A1 Mar. 24, 2005

(30) Foreign Application Priority Data

Sep. 22, 2003 (JP) ..... 2003-330062

(51) Int. Cl.
*G03G 15/00* (2006.01)

(52) U.S. Cl. ..... 399/406; 399/401; 271/188; 271/209

(58) Field of Classification Search ..... 399/45, 399/49, 389, 390, 401, 406; 271/161, 188, 271/209

See application file for complete search history.

(56) References Cited

U.S. PATENT DOCUMENTS 5,933,698 A * 8/1999 Muramatsu ..... 399/406

FOREIGN PATENT DOCUMENTS

| | | | |
|---|---|---|---|
| JP | 06258906 A | * | 9/1994 |
| JP | 2001122498 A | * | 5/2001 |
| JP | 2001337564 A | * | 12/2001 |
| JP | 2002-080157 A | | 3/2002 |

* cited by examiner

*Primary Examiner*—Ren Yan
(74) *Attorney, Agent, or Firm*—Canon U.S.A., I.P. Division

(57) ABSTRACT

A sheet curl correcting device and an image forming apparatus incorporating the same. The image forming apparatus includes a fixing unit for fixing a toner image transferred by an electrophotographic image forming unit to a sheet, a pair of rollers having different hardnesses for correcting a sheet curl, a controlling unit for controlling a deformation amount of one of the rollers in accordance with a table of curl correction amounts, and a curl correction limiter for limiting the curl correction amount if the sheet is to be discharged to a stacker.

15 Claims, 11 Drawing Sheets

FIG. 8

| CURL AMOUNT BASED ON DEFORMATION AMOUNT AND TONER AMOUNT PLAIN SHEET(UNITS: mm, PLUS = UPWARD CURL, MINUS = DOWNWARD CURL) | | | | | | |
|---|---|---|---|---|---|---|
| SHEET TYPE | BASIS WEIGHT $g/m^2$ | TONER AMOUNT (g/A4) | NO CURL CORRECTION | DEFORMA-TION AMOUNT 0.2 mm | DEFORMA-TION AMOUNT 0.7 mm | DEFORMA-TION AMOUNT 1.2 mm |
| PLAIN SHEET | 80 g | 0.4 | 4 | 4 | -5 | -18 |
| | | 0.8 | 15 | 15 | 3 | -12 |
| | | 0.9 | 18 | 18 | 6 | -7 |
| | | 1.2 | 23 | 23 | 12 | -3 |

FIG. 9

| RELATIONSHIP BETWEEN SHEET TYPE/SHEET THICKNESS AND CURL CORRECTION | | |
|---|---|---|
| SHEET TYPE/SHEET THICKNESS | | CURL CORRECTION |
| PLAIN SHEET | EQUAL TO OR LESS THAN 105 $g/m^2$ | CARRIED OUT |
| | EQUAL TO OR GREATER THAN 106 $g/m^2$ | NOT CARRIED OUT DURING DEFAULT |
| | | CARRIED OUT ONLY DURING MANUAL CORRECTION |
| OHP SHEET | | NOT CARRIED OUT |

FIG. 10

| CURL CORRECTION TABLE | | | | | | | | | | | |
|---|---|---|---|---|---|---|---|---|---|---|---|
| | | TONER AMOUNT (g/A4) | | | | | | | | | |
| | | 0 | | 0.4 | | 0.6 | | 0.8 | | 1 | 1.2 |
| STANDARD CONDITION | | DEFORMATION AMOUNT 0.2 mm | | | 0.7 mm | | | | | 1.2 mm | |
| WITH STACKER | | 0.2 mm | | | 0.7 mm | | | | | | |
| MANUAL CORRECTION | STRONG 3 | 1.2 mm | | | | | | | | | |
| | STRONG 2 | 0.7 mm | | 1.2 mm | | | | | | | |
| | STRONG 1 | 0.2 mm | 0.7 mm | | | 1.2 mm | | | | | |
| | WEAK 1 | 0.2 mm | | | | 0.7 mm | | | | | 1.2 mm |
| | WEAK 2 | 0.2 mm | | | | | | 0.7 mm | | | |
| | WEAK 3 | 0.2 mm | | | | | | | | | |

FIG. 11

| CURL AMOUNT ② BASED ON DEFORMATION AMOUNT AND TONER AMOUNT COATED SHEET A(UNITS: mm, PLUS = UPWARD CURL, MINUS = DOWNWARD CURL) | | | | | | |
|---|---|---|---|---|---|---|
| SHEET TYPE | BASIS WEIGHT $g/m^2$ | TONER AMOUNT (g/A4) | NO CURL CORRECTION | DEFORMA-TION AMOUNT 0.2 mm | DEFORMA-TION AMOUNT 0.7 mm | DEFORMA-TION AMOUNT 1.2 mm |
| COATED SHEET A | 105 g | 0.4 | 7 | 7 | -2 | -11 |
| | | 0.8 | 17 | 17 | 7 | -2 |
| | | 0.9 | 20 | 20 | 10 | 1 |
| | | 1.2 | 28 | 28 | 18 | 8 |

CURL CORRECTING DEVICE AND IMAGE FORMING APPARATUS

CROSS REFERENCE TO RELATED APPLICATIONS

This application claims priority from Japanese Patent Application No. 2003-330062 filed Sep. 22, 2003, which is hereby incorporated by reference herein.

BACKGROUND OF THE INVENTION

1. Field of the Invention

The present invention relates to a curl correcting device for correcting-the curl of a sheet.

2. Description of the Related Art

In general, an image forming apparatus using an electrophotographic technique forms an image by developing an electrostatic latent image formed on an image carrier (such as a photosensitive member) in accordance with image information by a developer in order to form a toner image. Then, the apparatus transfers the toner image onto a sheet either directly or indirectly through an intermediate transferring unit. Then, the apparatus passes the sheet between a fixing heating roller and a pressure roller or a belt of a press-contact section in order to fix the toner image to the sheet. After the image is fixed to the sheet, the sheet may curl in the direction of the front or the back of the sheet. Therefore, there are some image forming apparatuses provided with a curl correcting device for correcting a sheet curl that is produced after the fixing operation in order to prevent problems caused by the curling, such as jamming of sheets, an increase in the space taken up by sheets at a sheet-discharge unit, and a reduction in the quality of images formed on both sides of a sheet.

The following types of curl correcting devices are primarily known. They are a roller nip type and a belt nip type. The roller nip type comprises an elastic roller and a pressure roller which rotates at a curved nip transporting section that is formed when the pressure roller presses the elastic roller. The belt nip type comprises a belt and a pressure roller. The belt rotates by being disposed on a belt supporting roller. The pressure roller rotates at a curved nip transporting section that is formed when the pressure roller presses the belt supporting roller. These curl correcting devices correct a sheet curl by passing the sheet to which an image is fixed through the curved nip transporting section (formed by the elastic roller or the belt and the pressure roller) in order to temporarily curve the curled sheet in a direction opposite to the direction of curl of the sheet.

Since the nature of the curl occurring after the fixing depends upon, for example, the type of sheet, the density of an image formed on a sheet, and the humidity of the environment, such curl correcting devices adjust the curl correction amount in accordance with a predetermined parameter, such as the type of sheet or the image density. In other words, in general, such curl correcting devices adjust the curl correction amount by changing the pressing amount of the pressure roller against the elastic roller or the belt, so that the curl correction amount (that is, the pressing amount of the pressure roller) is changed and controlled in accordance with detection information regarding, for example, the type of sheet used, the image density, or the humidity.

In general, such curl correcting devices adjust the curl correction amount by previously providing and storing control information in which a condition, such as the sheet type, the image density, or the humidity, is associated with the curl correction amounts, and by automatically controlling the pressing amount of the pressure roller on the basis of the control information.

In recent years, in the print on demand (POD) market, a post-processor which can be used to load a large number of sheets, such as a stacker, is becoming important. The required curl correction amount when sheets are discharged onto a sheet-discharge tray from the body of the image forming apparatus and that when the sheets are loaded onto a post-processor, such as a stacker, from the body of the image forming apparatus are different due to loading conditions, such as a difference in height from a sheet-discharge opening to a loading surface. In general, in a stacker for loading a large number of sheets, the distance from the sheet-discharge opening to the loading surface is large. Therefore, a sheet that is curled downward tends to buckle when it lands in the stacker. In order to prevent this, it is necessary to eliminate the downward curl compared to the case where the sheet is discharged onto the sheet-discharge tray. Accordingly, it is necessary to limit the curl correction strength applied to the sheet in accordance with the connected post-processor, so that a controlling operation for limiting the curl correction strength is carried out.

Due to the diversification of sheets in recent years, a sheet curl may not be properly corrected by the above-described automatic correction. One example of such a sheet is a sheet having a surface coated with resin and being frequently used in the POD market. Such a coated sheet tends to be curled by toner because it has low resilience compared to a related non-coated sheet of the same thickness (basis weight). Therefore, it is not enough to merely classify sheets in accordance with the thickness as a parameter as is conventionally the case. In addition, the amount of curl of a coated sheet depends on, for example, the amount and the composition of the resin used for coating, and whether or not one side or both sides of the sheet are coated. Therefore, it is difficult to carry out the same controlling operation on the correction amount of different types of coated sheets.

Even if a sheet is of a type whose curl correction amount can be automatically adjusted, the curl of the sheet type may not be properly corrected depending upon, for example, the humidity of the environment and the state in which the sheet type is left standing.

In order to overcome this problem, Japanese Patent Laid-Open No. 2002-80157 discloses a curl correcting device comprising means for manually correcting a sheet curl in order to make it possible to properly correct the sheet curl.

However, when a post-processor is mounted, and the curl correction strength is limited, proper correction cannot be carried out due to the diversification of sheets.

SUMMARY OF THE INVENTION

The present invention is directed to a curl correcting device which can correct curls of various types of sheets.

In one aspect of the present invention, a curl correcting device, for use with an image forming apparatus capable of forming a toner image onto a sheet and discharging the sheet to a sheet loading unit, includes a curl corrector operable to correct a curl amount of the sheet; a controller controlling the curl corrector in accordance with a table of curl correction amounts; and a curl correction limiter possible to limit the curl correction amount by the curl corrector in accordance with a type of the sheet loading unit.

The present invention is also directed to an image forming apparatus incorporating the curl correcting device. In another aspect of the present invention, an image forming apparatus includes image forming means for forming an image on a sheet; a sheet loading unit for receiving the sheet having the image; a curl corrector operable to correct a curl amount of the sheet; a controller controlling the curl corrector in accordance with a table of curl correction amounts; and a curl correction limiter possible to limit the curl correction amount by the curl corrector in accordance with a type of the sheet loading unit.

In yet another aspect of the present invention, an image forming apparatus for forming an image on a sheet includes an image forming unit transferring a toner image onto the sheet; a fixing unit fixing the transferred toner image to the sheet; a curl correcting unit disposed downstream from the fixing unit, the curl correction unit including first and second rollers receiving therebetween the sheet having the fixed toner image, the first and second rollers contacting each other to deform by a deformation amount; at least one of a discharge tray and a stacker receiving the sheet from the curl correcting unit; a controller controlling the first and second rollers to deform by a deformation amount in accordance with a table of curl correction amounts; and a curl correction limiter possible to limit the curl correction amount by the curl correcting unit responsive to the stacker receiving the sheet.

Further features and advantages of the present invention will become apparent from the following description of a preferred embodiment with reference to the attached drawings.

BRIEF DESCRIPTION OF THE DRAWINGS

FIG. 8 is a table providing curl amounts based on deformation amount and toner amount.

FIG. 9 is a table illustrating a relationship between sheet type/sheet thickness and curl correction in accordance with the present invention.

FIG. 10 is a table illustrating curl correction in accordance with the present invention.

FIG. 11 is a table illustrating curl correction in accordance with the present invention.

DESCRIPTION OF THE EMBODIMENT

Figure 1:
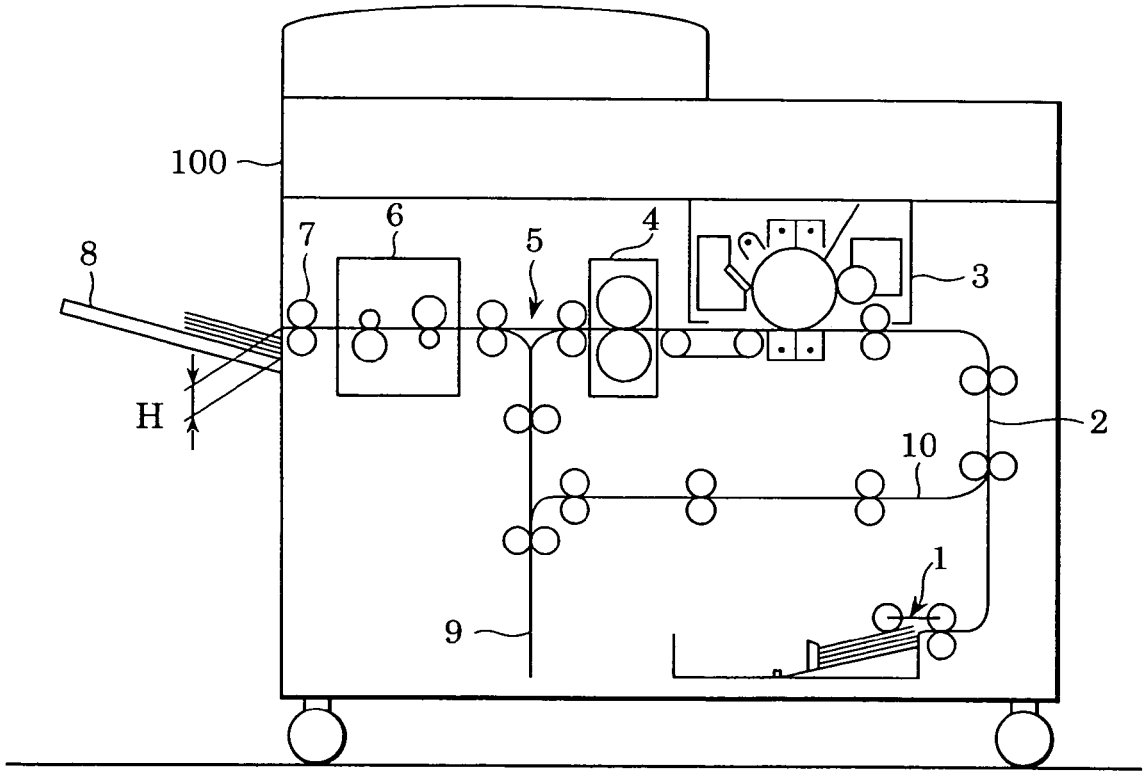
FIG. 1 is a sectional view of a copying machine comprising a curl correcting device according to an embodiment of the present invention.

FIG. 1 is a principal sectional view of an electrophotographic copying machine 100 according to an embodiment of the present invention. A sheet fed from a sheet-feed unit 1 passes through a sheet-feed transportation path 2. Then, the sheet is transported to an image forming unit 3 where a toner image is transferred to the sheet, and then to a fixing unit 4 where the toner image is fixed to the sheet by fusing the toner image. When printing is to be carried on one side of the sheet, the sheet passes straight through a fork path 5, is predeterminately curled at a curling unit 6, and is discharged to a sheet-discharge tray 8 from a sheet-discharge unit 7 of the body of the copying machine 100. When printing is to be carried out on both sides of the sheet, the sheet is transported downward at the fork path 5, passes through a reversing path 9 and a refeeding path 10, returns to the image forming unit 3 in order to transfer and fix an image to the sheet, is curled, and is discharged from the copying machine 100. Although the sheet-feed unit 1 is shown as having only one sheet-holding section, it may have a plurality of sheet-holding sections for holding various types of sheets, so that a sheet may be selected and fed in accordance with the purpose of use.

Figure 2:
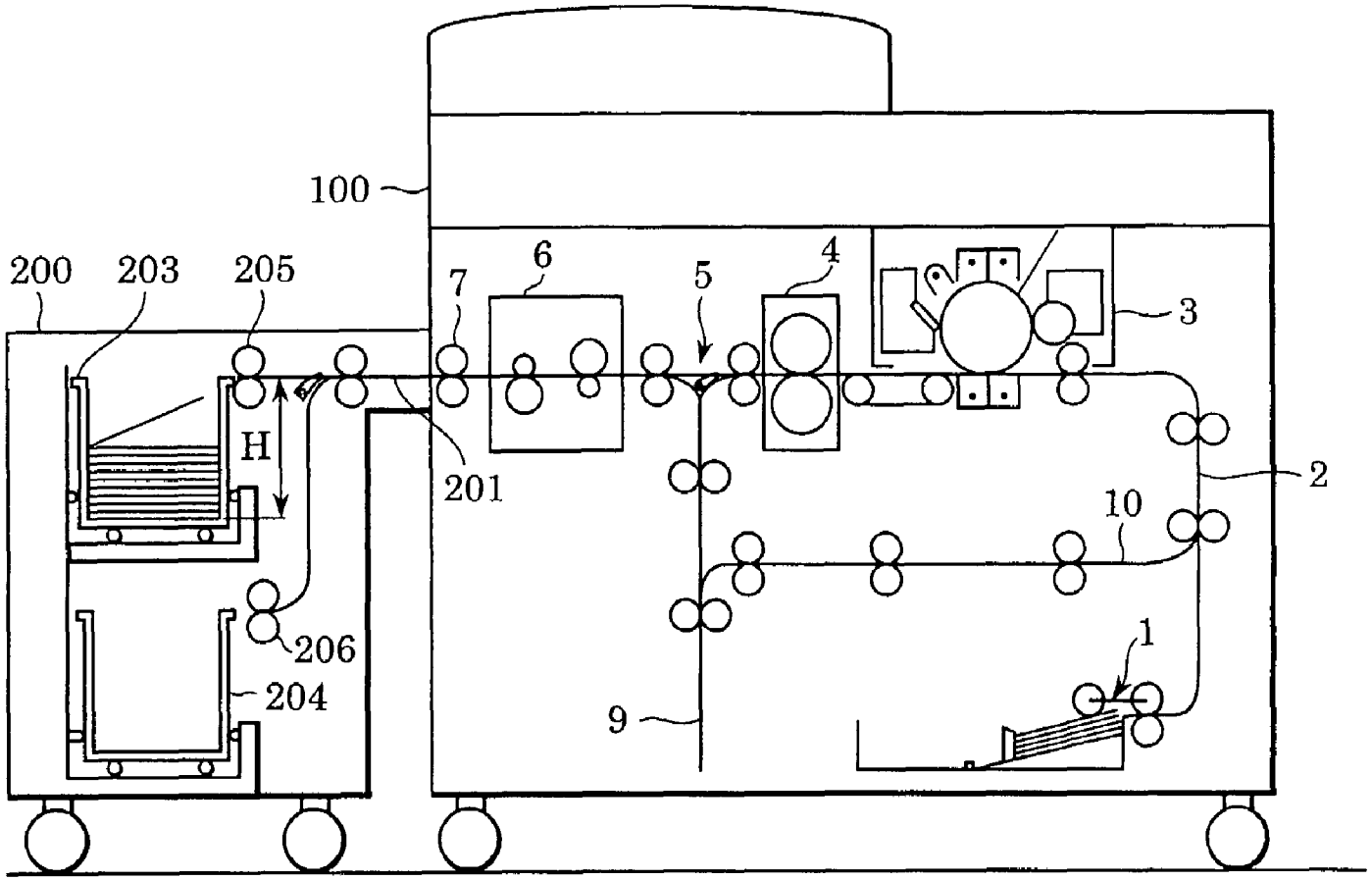
FIG. 2 is a sectional view showing a state in which a stacker is mounted to the copying machine shown in FIG. 1.

FIG. 2 shows a stacker 200, serving as a post-processor, connected to the body of the copying machine 100 shown in FIG. 1. The stacker 200 is mounted by removing the sheet-discharge tray 8 shown in FIG. 1. When the stacker 200 is to be mounted, a body controller can determine whether or not the stacker 200 is mounted by a signal exchange between the stacker 200 and the body. A sheet transported from the body of the copying machine passes through a transportation path 201 in the stacker and is discharged into a stack basket 203 or a stack basket 204. Reference numerals 205 and 206 denote sheet-discharge sections for discharging sheets into the stack baskets 203 and 204, respectively.

Structure of Correcting Device

Figure 3:
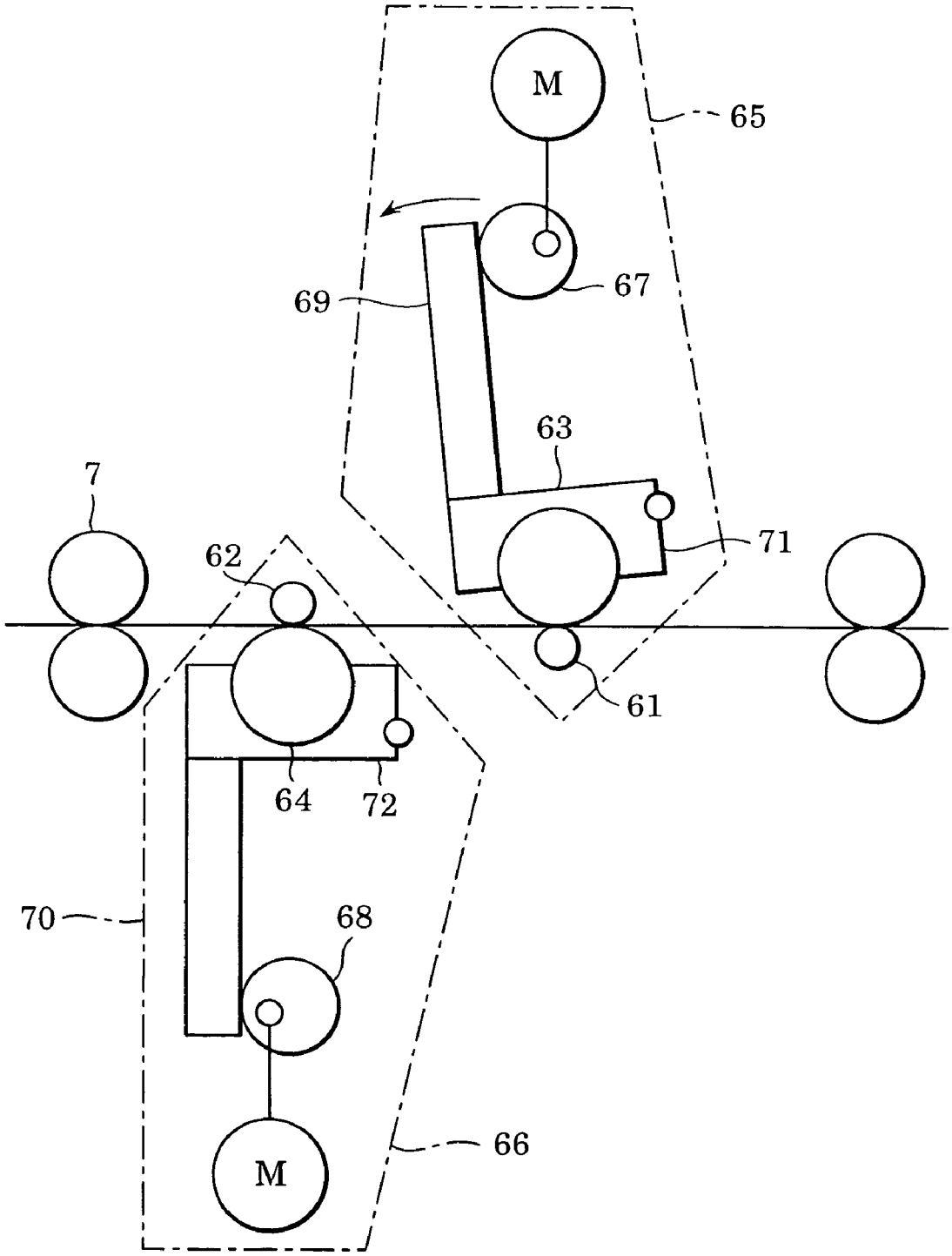
FIG. 3 is a sectional view of a curl correcting unit of the curl correcting device shown in FIG. 1.

FIG. 3 shows the curl correcting unit in detail. The correcting unit comprises a downward curling section 65 and an upward curling section 66. A sheet is curled by interposing the sheet between metallic curling rollers 61 and 62 and pressure rollers 63 and 64. The pressure rollers 63 and 64 are sponge rollers integrally formed with core bars. The curling can be adjusted by three amounts by switching the deformation amount between the curling rollers and the pressure rollers by 0.2 mm, 0.7 mm, and 1.2 mm. The larger the deformation amount, the larger the curling strength. The deformation amount is switched by changing the pushing amount of cams 67 and 68 against arms 69 and 70 extending from respective holders 71 and 72 holding the respective pressure rollers 63 and 64 as a result of rotating the cams 67 and 68 driven by respective motors M by ¼ of a complete rotation each time. During standby, the cams 67 and 68 are stopped at an angle (home position) at which the pushing amount is smallest, and the deformation amount is 0.2 mm.

The curl correcting unit is capable of correcting a sheet curl that is produced at, for example, the fixing unit 4 by curling the sheet in a direction opposite to the direction of curl of the sheet.

When the sheet is to be curled downward, the downward curling section 65 is set at a deformation amount determined by a control table, and the upward curling section 66 is kept at home position. When the sheet is to be curled upward, the upward curling section 65 is set at a deformation amount determined by the control table, and the downward curling section 66 is kept at home position. After passing the sheet, the associated cam returns to the home position.

Concept of Correcting Sheet Curl and Mechanism of Producing Curl

When toner melted by the fixing contracts as a result of being cooled, the side of the sheet having the toner fixed thereto (toner surface) is curled inward. (When printing is carried out on both sides of the sheet, the side of the sheet having a larger amount of toner thereon is curled inward.) Therefore, the sheet curl is corrected by curling the toner surface (or the surface having a larger amount of toner thereon) in a direction in which it becomes a protruding shape.

In other words, when two-sided printing is carried out, the curl correction capability of the curl correcting unit is changed on the basis of the difference between the density of an image formed on a first surface and the density of an image formed on a second surface, and the curling unit corrects the sheet curl by curling the sheet so that, of the first and second surfaces, the surface having a lower image density is on the inside.

Since a larger amount of toner corresponds to a larger curl amount, the curl correction strength that is applied is high when the image density (that is, the amount of toner on the sheet per unit area) is high, whereas the curl correction strength that is applied is low when the image density is low. A lower rigidity of a sheet type increases the tendency of the sheet to curl because it is overcome by the toner contraction force. A sheet which is light per unit area (that is, has a low basis weight), such as a plain sheet or a thin sheet, is subjected to curl correction, whereas a sheet which is heavy per unit area (that is, has a high basis weight), such as a thick sheet, is not subjected to the curl correction.

The contraction of the toner continues with time. Therefore, taking this into consideration, the curled sheet is slightly over-curled immediately after it is discharged in order to adjust the curling so that the sheet is substantially flattened with time.

Curl Correction Table

In order to automatically correct for curl, controlling means controls the curl correcting unit on the basis of sheet type information and image information. The sheet type information refers to information regarding at least one of the size, the material, the thickness, and the density of the sheet. The image information includes a curl correction table based on information regarding toner amount corresponding to the density of an image formed on the sheet. This embodiment of the present invention will hereunder be described by using a curl correction table based on the sheet material, the sheet thickness, and the toner amount.

Curl Amount when Curl Correction is not Carried Out

Figure 7:
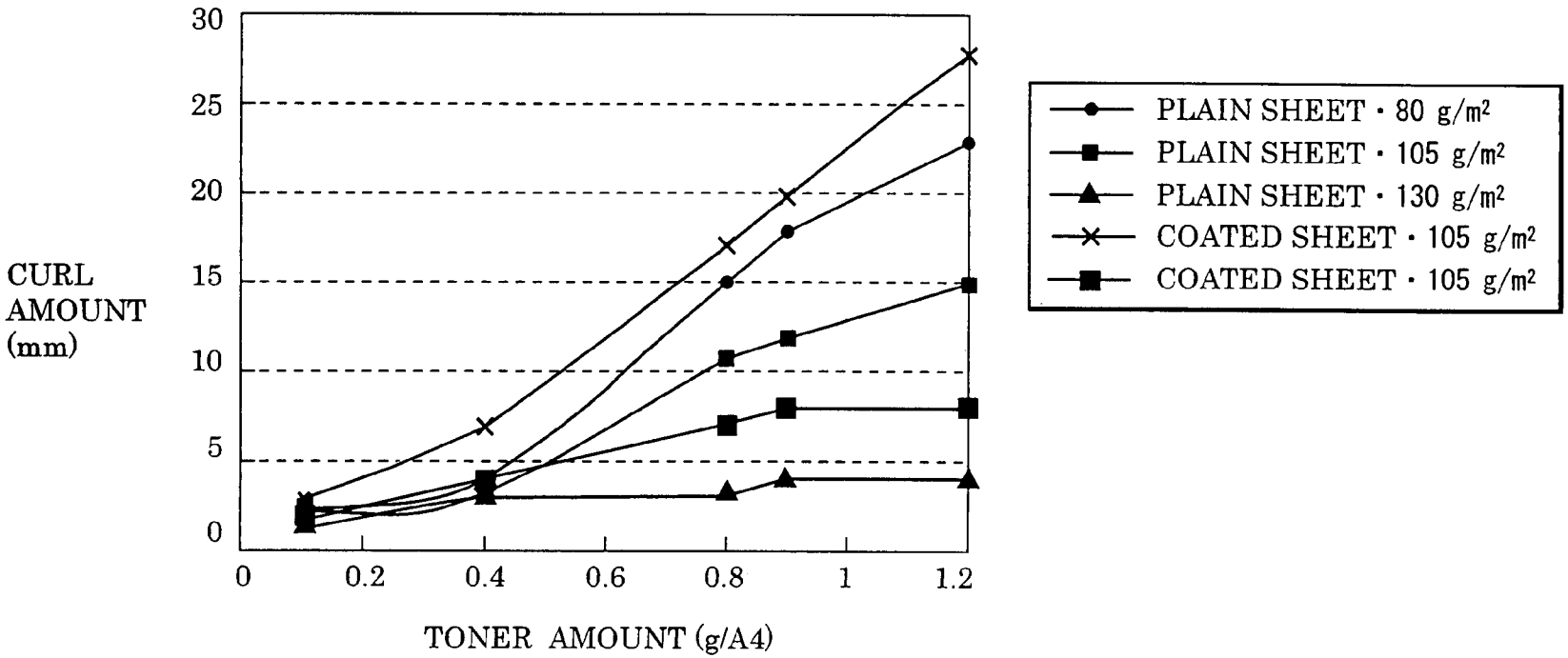
FIG. 7 is a graph showing the relationship between a toner amount and a curl amount.

A graph of FIG. 7 shows actual measurement data regarding the curl amount of each type of sheet when curl correction is not carried out. The horizontal axis represents the toner amount in grams per A4 size sheet, and the vertical axis represents the curl height when the direction in which the toner surface is rounded inward is positive. The graph is a plot for three plain sheets of the same type having different thicknesses, and two different types of coated sheets A and B having the same thickness. The graph shows that (1) the curl amount increases as the toner amount increases for all types of sheets, (2) the curl amount is reduced as the thicknesses of the plain sheets are increased, and (3) there are large variations in the curl amounts of the coated sheets according to the coated sheet type.

When a plain sheet is allowed to be upwardly curled by 5 mm, and is required to be subjected to curl correction when it is curled by more than 5 mm, the plain sheet is required to be subjected to curl correction when the toner amount is greater than 0.4 g/A4 at a basis weight of 80 g/m$^2$, and is not required to be subjected to curl correction regardless of the toner amount at a basis weight of 130 g/m$^2$. Here, the toner amount is given in grams per A4 size sheet.

Curl Amount After Correction

FIG. 8 shows a table providing actual measurement data regarding deformation amounts of a curling roller and curl amounts after the correction.

From the table of FIG. 8, in the case where a plain sheet of 80 g/m$^2$ is used, a deformation amount of 0.2 mm when the toner amount is equal to or less than 0.4 g/A4, a deformation amount of 0.7 mm when the toner amount is equal to or greater than 0.4 g/A4 and less than 0.9 g/A4, and a deformation amount of 1.2 mm when the toner amount is equal to or greater than 0.9 g/A4 are considered adequate.

From these pieces of data, it is possible to determine a curl correction table in a standard condition in which a plain sheet and a sheet-discharge tray are used.

Manual Correction Table

As mentioned above, even if the toner amount is the same for the coated sheets, the curl amounts differ depending upon the type of coated sheet. Therefore, whether or not correction is required and the required correction strength depend upon the type of coated sheet. For example, when the toner amount is 0.4 g/A4, the coated sheet A needs to be subjected to curl correction, whereas the coated sheet B does not need to be subjected to curl correction. In other words, in forming a curl correction table, the curls of the coated sheets may not be completely corrected by using a plain sheet curl correction table, and the curl amount depends upon the type of coated sheet. Therefore, it is necessary to manually change the correction amount.

In order to achieve this, a plurality of tables in which threshold values for changing the deformation amount by the curling rollers are made different from those in the standard condition. Here, a total of six correction tables, that is, three correction tables in which the threshold values of the toner amount are smaller than those in the standard condition, and three correction tables in which the threshold values of the toner amount are larger than those in the standard condition are formed. When the threshold value is reduced, a strong curl correction is carried out with a small toner amount, whereas, when the threshold value is increased, a weak curl correction is carried out with a large toner amount.

Discharge to Stacker 200

The sheet-discharge tray 8 shown in FIG. 1 and the stacker 200 shown in FIG. 2 serve as sheet-loading units for loading discharged sheets. Assuming that 250 to 300 sheets are loaded, a height H (see FIG. 1) when the sheet-discharge tray 8 is used is 65 mm. Assuming that 1000 sheets are stacked in the basket, a height H (see FIG. 2) when the stacker 200 is used is 150 mm.

Since the height H between a sheet-loading surface of the stacker 200 and a location between the discharge rollers 205 and 206 is greater than the height H between a sheet-loading surface of the sheet-discharge tray 8 and the sheet-discharge unit 7, when the downward curling strength is large, an end of a discharged sheet is curved inward when it lands in the stacker 200. Therefore, the following sheets that are discharged can no longer be loaded.

When the toner amount is equal to or greater than 0.9 g/A4 and the deformation amount of 1.2 mm in the table of FIG. 8, the sheet is curled downward and inward. This reduces the loading capability. Therefore, it is necessary to reduce the downward curling strength. To achieve this, it is necessary to provide a curl correction table in which curling with a deformation amount of 1.2 mm is not carried out even if the toner amount is equal to or greater than 0.9 g/A4, and in which the maximum deformation amount is 0.7 mm. In other words, a limit is imposed upon the correction amount.

Curl Correction Table in the Present Invention

FIG. 9 and FIG. 10 are curl correction tables in accordance with the present invention. The curl correction tables are derived from, for example, the aforementioned data. In other words, for a plain sheet, whether or not curl correction is carried out depending upon the sheet thickness is automatically set, and, for special types of sheets such as an OHP sheet, curl correction is not carried out. The curl correction amount is determined on the basis of whether a sheet is discharged to the sheet-discharge tray 8 or to the stacker 200. In this case, a proper curl correction amount is automatically set on the basis of the toner amount. Such curl correction is carried out by operating the curl correcting unit on the basis of the tables shown in FIGS. 9 and 10.

For example, a sheet having an image density or a toner amount of 0.5 g/A4 and a basis weight of 80 g/m$^2$ is to be printed on one side and output to the sheet-discharge tray, the associated cam is controlled by the motor so that the pressure roller 63 of the downward curling section 65 penetrates the curling roller 61 by 0.7 mm in order to carry out curling.

Setting Operation when Carrying Out Manual Correction

Figure 4:
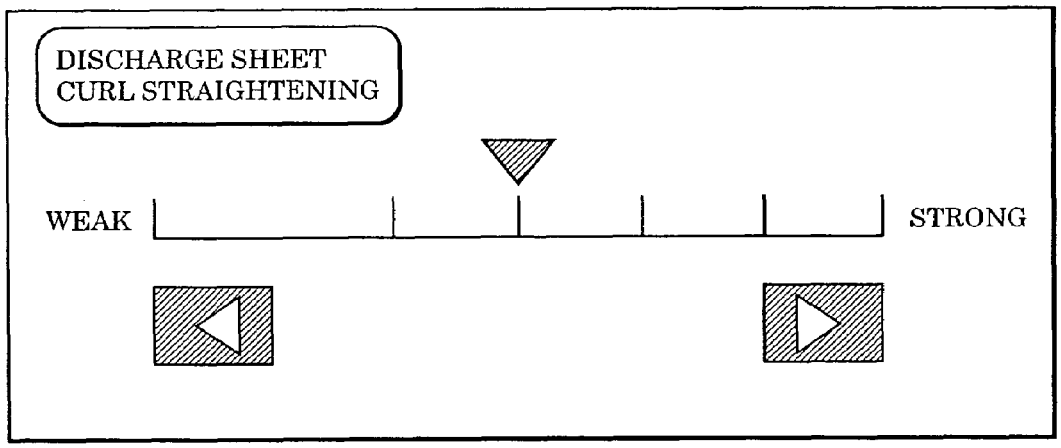
FIG. 4 shows a manual adjustment screen of the curl correcting device.
Figure 5:
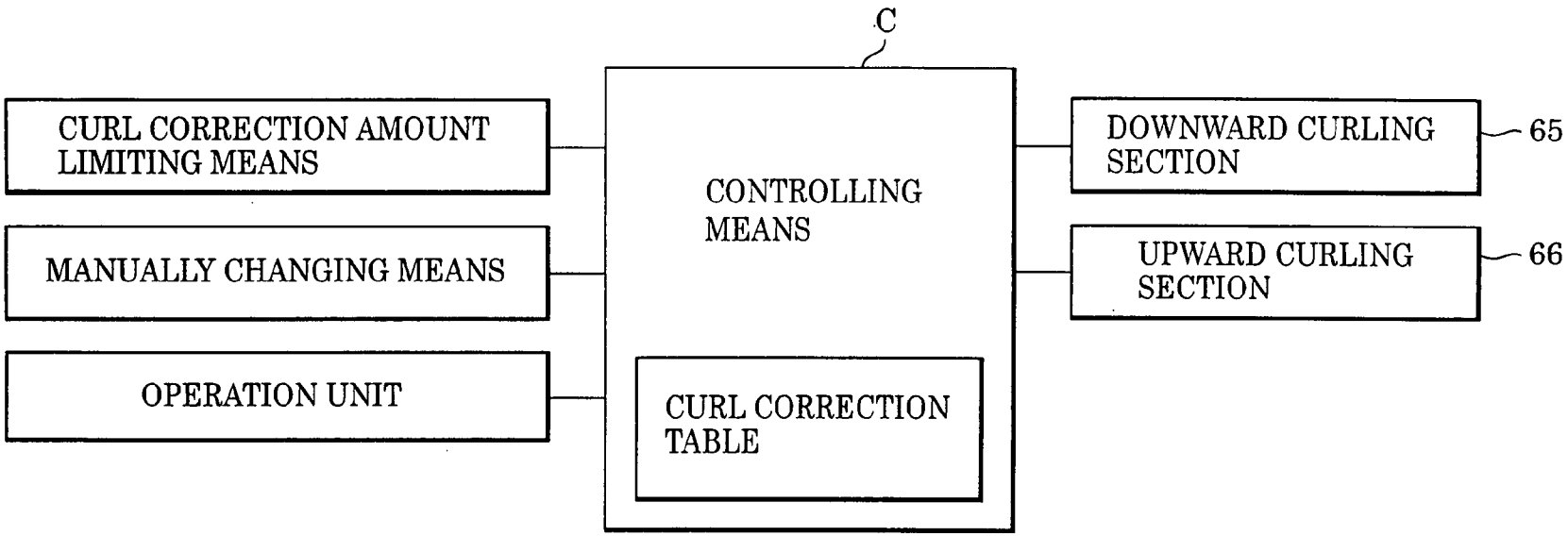
FIG. 5 is a block diagram of controlling means.

FIG. 4 shows a screen for setting a manual adjustment means serving as manually changing means in the present invention displayed on a touch panel of an operation unit of the body. The correction can be set, for example, in seven levels from "weak" to "strong." In a default state, the manually changing means is set at the center between "weak" and "strong." By touching a left triangular mark or a right triangular mark on the touch panel, a black reference mark is moved leftwards or rightwards in order to change the curl correction setting.

More specifically, when the image density is 0.8 g/A4, the curl correction at the time of default is carried out with a deformation amount of 0.7 mm. By moving and setting the reference mark to one graduation towards "strong," the correction is carried out with a deformation amount of 1.2 mm.

Manual Correction when Stacker 200 is Mounted

As mentioned above, when the stacker 200 is mounted to the body, the upper limit of the deformation amount at the time of default is 0.7 mm. In order to properly correct sheet curls that are different from those of related sheets, the setting of a limit on the deformation amount is canceled when manual correction is set in order to carry out the manual correction in accordance with a manual correction table. FIG. 11 is a table illustrating the relationship between the curl amount and the deformation amount for the coated sheet A. As is clear from the graph of FIG. 7, the coated sheet A is curled by a greater amount than the plain sheets. Since a coated sheet is a thin sheet coated with resin, it has low resilience with respect to its basis weight. There are many sheets which are curled by a large amount like a coated sheet.

In the case where manual correction is not set, when the stacker is mounted, the deformation amount is 0.7 mm even if the toner amount is equal to or greater than 0.9 g/A4. Therefore, the curl amount of 18 mm with a toner amount of 1.2 g/A4 is too large, thereby making it possible to give rise to loading failure caused by upward curling. To overcome this problem, the manual correction is set to one graduation towards "strong" in order to cancel the limited deformation amount at 0.7 mm, and to control the deformation amount to 1.2 mm with a toner amount that is equal to or greater than 0.5 g/A4, thereby making it possible to flatten the sheet and, thus, ensure the loading capability. In this way, when manual correction is set, the limiting function of the curl correction limiting means is cancelled in order to carry out correction by an amount set by the manual correction.

Block Diagram of Controlling Means

Controlling means C stores curl correction tables and controls the downward curling section 65 or the upward curling section 66 when necessary by extracting data from the curl correction tables, on the basis of the sheet type information and the image information input from the operation unit. The controlling means C causes detecting means (not shown) to detect whether the sheet-discharge tray 8 or the stacker 200, serving as a post-processor, is connected, and carries out a controlling operation so that the curl correction limiting means corrects the curl correction amount in accordance with the detected result. In the case where the curl correction amount is limited by the curl correction limiting means, when manual correction is carried out from the touch panel of the operation unit, the limiting operation of the curl correction limiting means is cancelled in order to carry out a controlling operation so that manual correction is given priority.

Flow of Controlling Process

Figure 6:
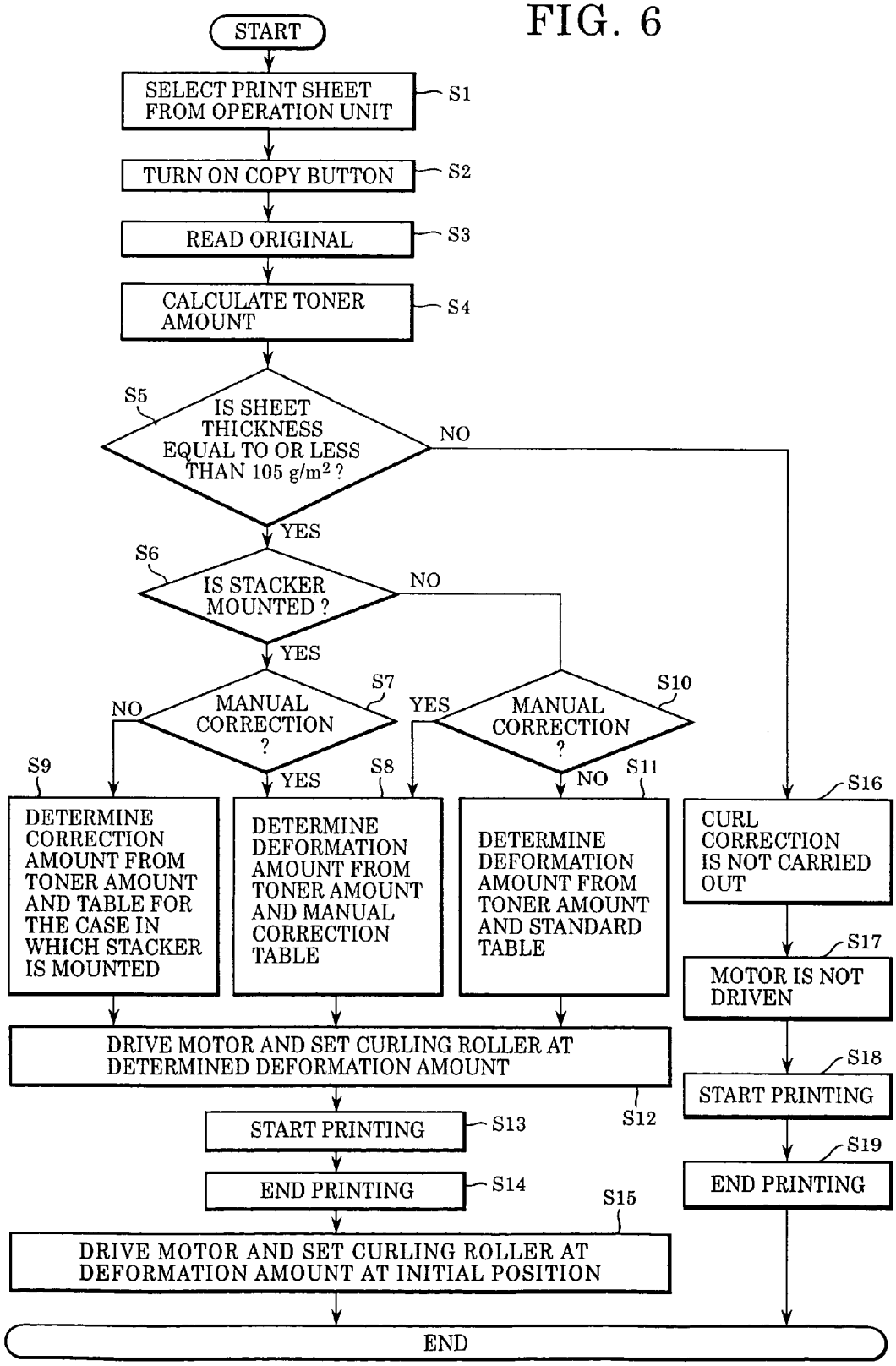
FIG. 6 is a flow chart of a curl correcting operation.

FIG. 6 is a flowchart of the embodiment, and will be described below.

When the controlling process is started, an original is set on an original table. A sheet on which printing is to be carried out is selected from the operation unit in Step S1. This makes it possible to supply a sheet to be used in accordance with the selection. After setting, for example, the number of copies as required, a copy button is turned on in Step S2.

In Step S3, the original is read. Then, in Step S4, the toner amount per A4 size is calculated from the read image information.

In Step S5, the sheet thickness setting is checked in order to determine whether or not the sheet thickness is equal to or less than 105 g/m$^2$. If it is equal to or less than 105 g/m$^2$, and it is determined that curl correction is required, the process proceeds to Step S6 in order to determine whether or not the stacker 200 is mounted. If it is determined that the stacker 200 is mounted in Step S6, the process proceeds to Step S7 in order to make a determination as to whether or not manual correction is to be set. If it is determined that the manual correction is to be set in Step S7, the process proceeds to Step S8 in order to determine a deformation amount from the strength of the manual correction and the toner amount calculated in Step S4 on the basis of a curl correction table.

When it is determined that manual correction is not to be set in Step S7, the process proceeds to Step S9 in order to determine the deformation amount from the toner amount when the stacker 200 is mounted on the basis of a curl correction table.

When a determination is made that the stacker 200 is not mounted in Step S6, the process proceeds to Step S10 in order to determine whether or not manual correction is set. If it is determined that the manual correction is to be set in Step S10, the process proceeds to Step S8 in order to determine a deformation amount from the strength of the manual correction and the toner amount calculated in Step S4 on the basis of the curl correction table. If it is determined that the manual correction is not to be set in Step S10, the process proceeds to Step S11 in order to determine a deformation amount from the toner amount in the standard condition when the stacker 200 is not mounted on the basis of a curl correction table.

When the deformation amount is determined in Step S8, S9, or S11, the cam 67 is rotated by driving the associated motor in order to cause the pressure roller 63 to penetrate the curl correction roller 61 by the determined deformation amount in step S12. Thereafter, in Step S13, printing is started. After the set number of copies is printed and the printing ends in Step S14, the pressure roller 63 is returned to its initial position in order to prepare for the next operation in Step S15.

When it is determined that the sheet thickness is equal to or greater than 106 g/m$^2$ in Step S5, it is determined that curl correction is not carried out in Step S16 as indicated in the table shown in FIG. 8. In Step S17, the curl correcting device is not driven. In Step S18, printing is started. The set number of copies is printed and the printing ends in Step S19.

Although in the embodiment two types of sheet loading units, that is, the sheet-discharge tray 8 and the stacker 200, are described, the present invention is not limited thereto. Therefore, the present invention may be applied to a plurality of sheet loading units that have different distances from the sheet discharge unit to a sheet loading surface of the sheet loading unit and that are selectively mountable to the body of the apparatus.

While the present invention has been described with reference to what are presently considered to be the embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A curl correcting device for use with an image forming apparatus capable of forming a toner image onto a plurality of sheets and discharging the sheets via a discharging unit to one of a plurality of sheet loading units mountable to the image forming apparatus, each sheet loading unit having a stacked portion with a discharge height and one sheet loading unit can have a stacked portion adapted to support the sheets and being positioned relative to the discharge unit by a constant discharge height different from another sheet loading unit, the curl correcting device comprising:

a curl corrector operable to correct a curl amount of each sheet;

a controller controlling the curl corrector in accordance with a table of curl correction amounts; and a curl correction limiter operable to limit the curl correction amount by the curl corrector in accordance with the constant discharge height of the sheet loading unit receiving the sheets.

2. The curl correcting device according to claim 1, further comprising a manual changer operable to manually change the curl correction amount set by the controller in accordance with the table, wherein the curl correction limiter is disengaged responsive to operation of the manual changer.

3. The curl correcting device according to claim 1, wherein the table of curl correction amounts is based on sheet type information including at least one of sheet size, sheet material, sheet thickness, and sheet density.

4. The curl correcting device according to claim 1, wherein the table of curl correction amounts is based on image information including a toner amount on each sheet.

5. The curl correcting device according to claim 3, wherein the controller controls operation of the curl corrector based on the sheet information.

6. The curl correcting device according to claim 1, wherein the curl corrector comprises first and second rollers receiving each sheet therebetween and operable to press contact each other so that the rollers deform by a deformation amount corresponding to a curl correction amount.

7. The curl correcting device according to claim 1, wherein the controller controls the curl corrector based on an amount of toner on a first surface and a second surface of each sheet.

8. The curl correction device according to claim 7, wherein the curl corrector curls the sheet towards the surface having the lower amount of toner.

9. An image forming a apparatus capable of forming a toner image onto a plurality of sheets and discharging the sheets via a discharging unit to one of a plurality of sheet loading units can be mounted thereto, wherein each sheet loading unit has a stacked portion adapted to support the sheets thereon and being positioned relative to the discharge unit by a constant discharge height and one sheet loading unit can have a stacked portion with a discharge height different from another sheet loading unit, the image forming apparatus comprising:

image forming means for forming an image on a plurality of sheets;

the sheet loading unit receiving the sheets having the image;

a curl corrector operable to correct a curl amount of each sheet;

a controller controlling the curl corrector in accordance with a table of curl correction amounts; and a curl correction limiter operable to limit the curl correction amount by the curl corrector in accordance with the constant sheet discharge height of the sheet loading unit receiving the sheets.

10. The image forming apparatus according to claim 9, further comprising a manual changer operable to manually change the curl correction amount set by the controller in accordance with the table, wherein the curl correction limiter is disengaged responsive to operation of the manual changer.

11. The image forming apparatus according to claim 9, wherein the table of curl correction amounts is based on sheet type information including at least one of sheet size, sheet material, sheet thickness, and sheet density.

12. The image forming apparatus according to claim 9, wherein the table of curl correction amounts is based on image information including a toner image density on each sheet.

13. An image forming apparatus for forming an image on a plurality of sheets, comprising:

an image forming unit transferring a toner image onto each sheet;

a fixing unit fixing the transferred toner image to the sheet;

a curl correcting unit disposed downstream from the fixing unit, the curl correction unit including first and second rollers receiving therebetween each sheet having the fixed toner image, the first and second rollers contacting each other to deform by a deformation amount and operable to correct a curl amount of each sheet;

a discharging unit configured to discharge the sheet;

sheets loading unit including one of a discharge tray and a stacker receiving the sheet from the curl correcting unit via the discharging unit, each of the discharge tray and the stacker having a stacked portion adapted to support the sheets thereon, the stacked portions of each of the discharge tray and the stacker being positioned relative to the discharging unit by constant discharge heights, the constant discharge height of the stacker being higher than the constant discharge height of the discharge tray;

a controller controlling the first and second rollers to deform by a deformation amount in accordance with a table of curl correction amounts; and a curl correction limiter operable to limit the curl correction amount by the curl correcting unit in the case of the stacker being mounted, such that the curl correction limiter limits the curl correction amount in accordance with the constant discharge height of the stacker.

14. The image forming apparatus according to claim 13, further comprising a setting unit operable to manually change the curl correction amount set by the controller in accordance with the table, wherein the curl correction limiter is disengaged responsive to operation of the setting unit.

15. The image forming apparatus according to claim 13, further comprising a refeeding path facilitating reversing an orientation of each sheet from a first side to a second side and retransporting the sheet to the image forming unit in order to form toner images on both sides of the sheet, wherein the controller controls the curl correction unit based on densities of the toner images formed on the first and second sides.

* * * * *